United States Patent [19]

Graf

[11] Patent Number: 4,770,025

[45] Date of Patent: Sep. 13, 1988

[54] PULLING CLAMP

[76] Inventor: Robert Graf, 1375 Sherwood Ave., North Tonawanda, N.Y. 14120

[21] Appl. No.: 53,032

[22] Filed: May 22, 1987

[51] Int. Cl.[4] ..... B21D 1/14

[52] U.S. Cl. ..... 72/422; 72/705; 294/86.4; 294/87.1; 24/489

[58] Field of Search ..... 72/705, 393, 302, 422; 269/152; 248/229; 294/86.4, 87.1, 103.1, 104; 24/489

[56] References Cited

U.S. PATENT DOCUMENTS

| | | | |
|---|---|---|---|
| 289,861 | 12/1883 | Schrepel | 269/152 |
| 2,585,158 | 2/1952 | Morganthaler | 72/705 |
| 2,588,509 | 3/1952 | Forster | 72/705 |
| 3,338,086 | 8/1967 | Hunter | 72/705 |
| 4,234,174 | 11/1980 | Cardono | 269/152 |
| 4,248,078 | 2/1981 | Russo | 72/705 |
| 4,606,216 | 8/1986 | Riutta | 72/705 |
| 4,649,730 | 3/1987 | Butler | 72/705 |

*Primary Examiner*—Lowell A. Larson

[57] ABSTRACT

A pulling clamp which can engage an automotive frame member at two points. The pulling clamp includes two elongated bow shaped members (12, 14) each of which is provided with at least one elongated slot (18) for the reception of a bolt (66) which is passed through suitable apertures in the frame member (56) to be pulled the bolt being held in place by a nut (68). The bow shaped members are spread apart by a threaded spreading member (34) to firmly clamp opposed side walls of the frame member between the head of the bolt, the nut, and the outer surfaces (20) of the pulling clamp. In one embodiment a second elongated slot (90) is provided inwardly of the first elongated slot (28) so that box sections of smaller width may be engaged by passing a bolt through a second set of elongated slots. In another embodiment threaded apertures (30, 42) are disposed inwardly of the elongated slots (28), which threaded apertures may receive additional gripping means (72).

5 Claims, 2 Drawing Sheets

PULLING CLAMP

TECHNICAL FIELD

The present invention relates generally to a device for straightening automobile frames, and more particularly to pulling clamps which can engage various frame members of an automotive body and which, after securement thereto, can pull these members back to there original specifications.

BACKGROUND OF THE INVENTION

It is well known in the prior art that automotive frames and sheet metal can be straightened and returned to substantially their original specifications by engaging the frame or sheet metal with a clamp and pulling the engaged member to restore the damaged part. One such example is shown in U.S. Pat. No. 3,744,838 which, in FIGS. 1 through 5 shows a first design for engaging sheet metal parts, and in FIGS. 6 and 7 a second design for engaging a frame members. A unibody pulling device such as that shown in U.S. Pat. No. 3,355,771, is designed to pull one side of the rail. Since a unibody rail is typically made up of two or more pieces of sheet metal which are formed into a box cross section, these types of clamps do not always pull properly. Thus, on a hard hit pull, this style of clamp can cause the rail to distort and loose its proper box shape. The only proper way to pull a unibody rail, which is typically made of high strength steels, is by pulling on both sides of the damaged rail. Also, if you pull a unibody car rail at one point only with a force of over 2,500 pounds, it is possible to break the sheet metal off at the clamp contact point. This will obviously result in more repair time. However, if the rail is secured at two points the frame technician has an option of using more power, up to perhaps 3,500 pounds, if needed.

When pulling on rails, such as skit rails or upper frame rails, which may not be box shaped, in the past it has been standard proctice to engage these members at one point only. By engaging such members at two longitudinally spaced apart points, additional pulling force can be exerted on the member, and furthermore, a double angle pull can be utilized.

OBJECTS AND SUMMARY OF THE INVENTION

It is a principal object of the present invention to provide a pulling clamp which may be secured to two points of an automobile frame in order to properly pull the frame.

More specifically, it is an object of the present invention to provide a rail pulling clamp which can be inserted into a box frame rail and secured thereto at two laterally spaced apart points so that proper pulling forces may be employed.

It is a further object of the present invention to provide a rail pulling clamp which may be inserted into box frame rails of varying diameters and properly secured thereto to laterally spaced apart locations.

It is an additional object of the present invention to provide a rail pulling clamp which may be secured to rails at longitudinally spaced apart points.

Thus, a rail pulling clamp is designed having two elongated bow shaped members which can be inserted into a box shaped rail and secured thereto at laterally spaced apart locations, a bolt being inserted into holes drilled in the frame member, the bolt also passing through elongated bolt receiving slots in the bow shaped members.

In one modification of the present invention, it is also possible to mount gripping means on the exterior surfaces of the bow shaped members to engage a rail between the gripping means and the bow shaped members which are inserted into the box rail.

A single bow shaped member may also be utilized when pulling on frame sections which are not of a box shape cross section by bolting the box shaped member to one location of the rail and then engaging another portion with the gripping means to provide the desired two point holding system.

The objects set foth above, and other objects and advantages of this invention will become more apparent after a consideration of the following detailed description taken in conjunction with the accompanying drawings in which two preferred forms of this invention are illustrated.

DETAILED DESCRIPTION

In General

Figure 1:
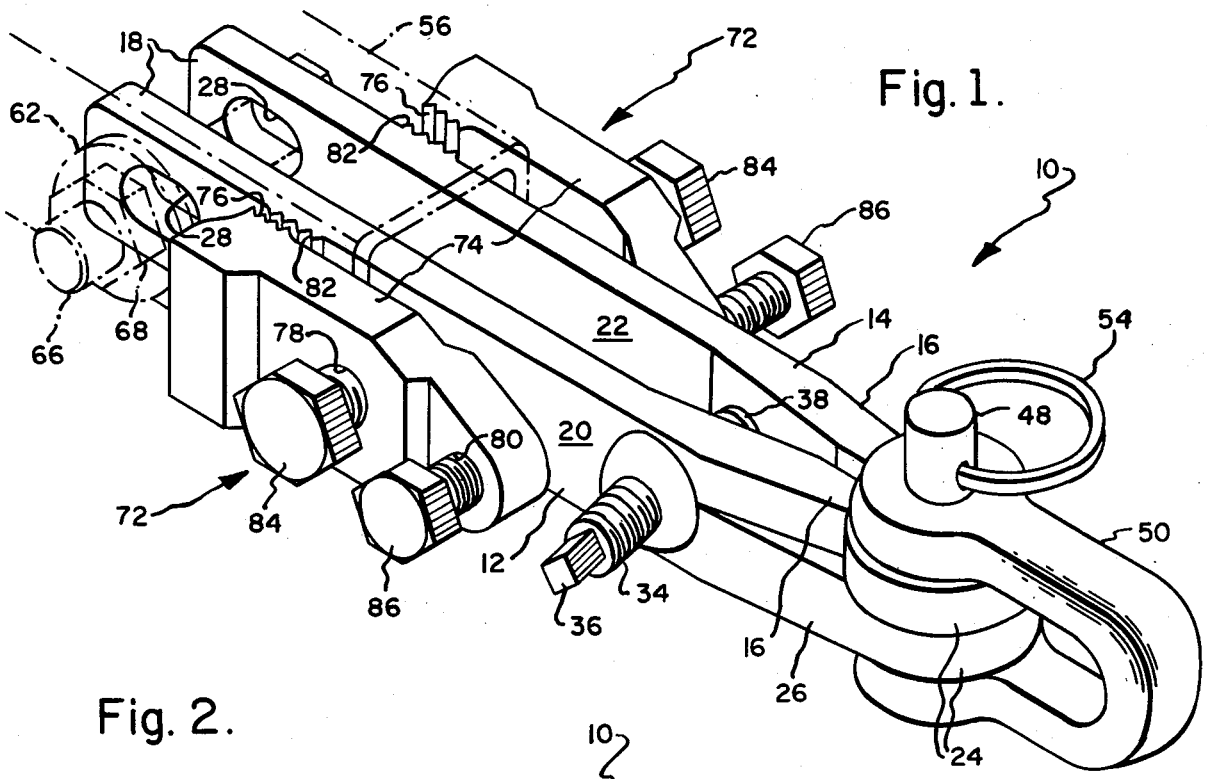
FIG. 1 is a perspective view of a first form of a rail pulling clamp.
Figure 2:
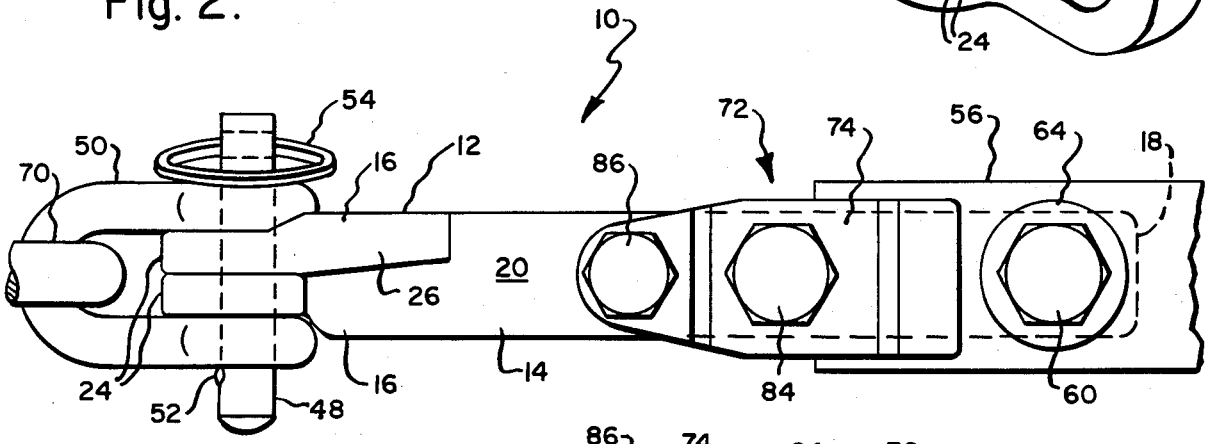
FIG. 2 is a top view of the clamp shown in FIG. 1.
Figure 3:
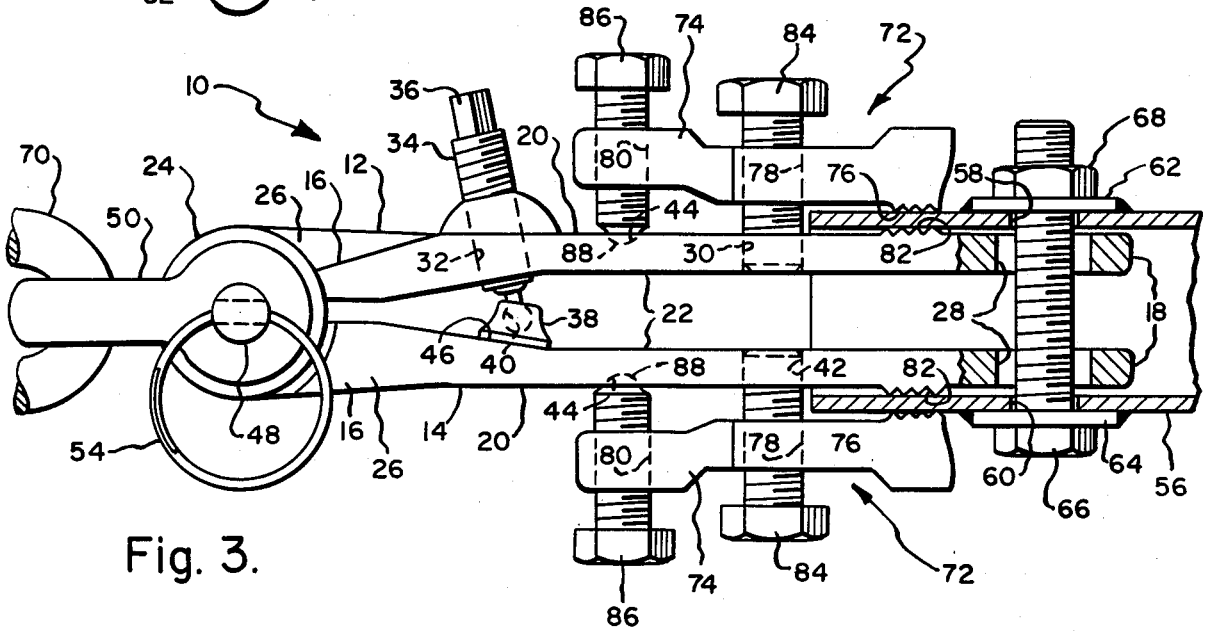
FIG. 3 is a side view of the clamp shown in FIG. 1, this view also illustrating an end portion of a box rail in cross section.
Figure 4:
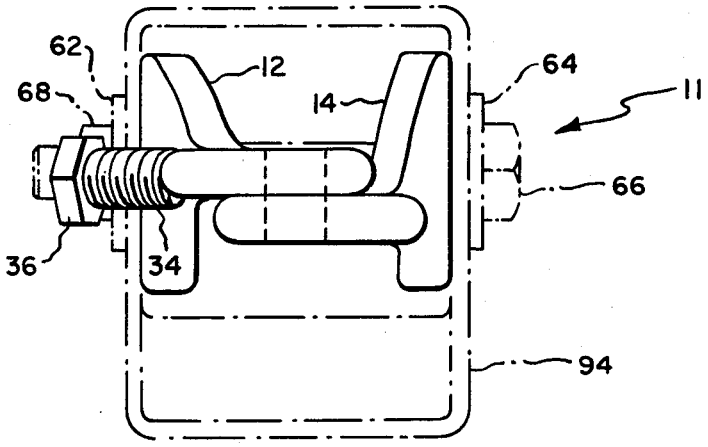
FIG. 4 is an end view of a section form of rail pulling clamp, this view showing a box frame in phantom lines.
Figure 5:
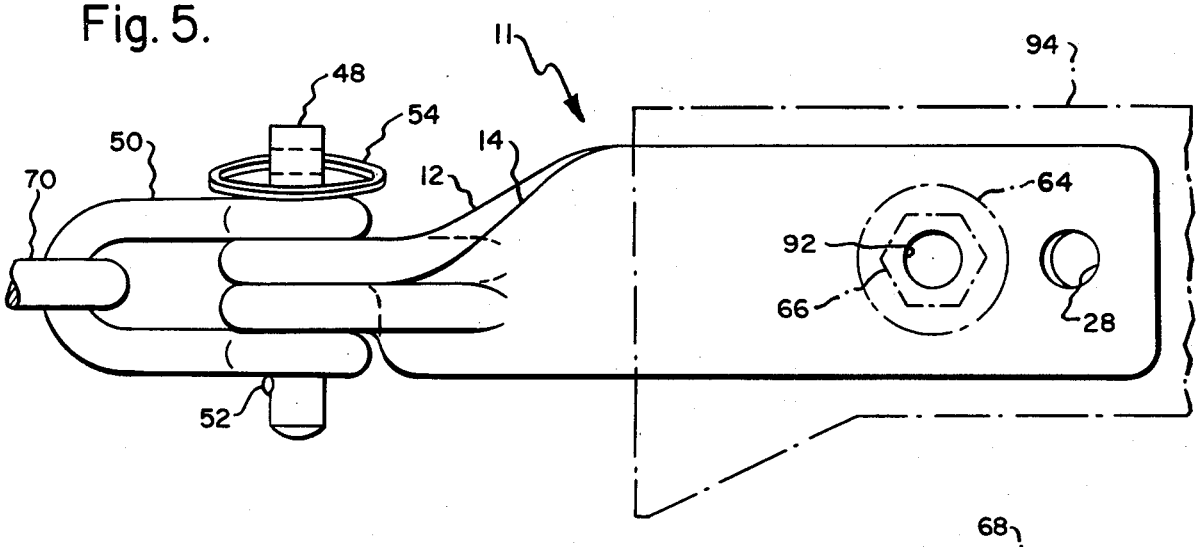
FIG. 5 is a side view of the rail pulling clamp shown in FIG. 4.
Figure 6:
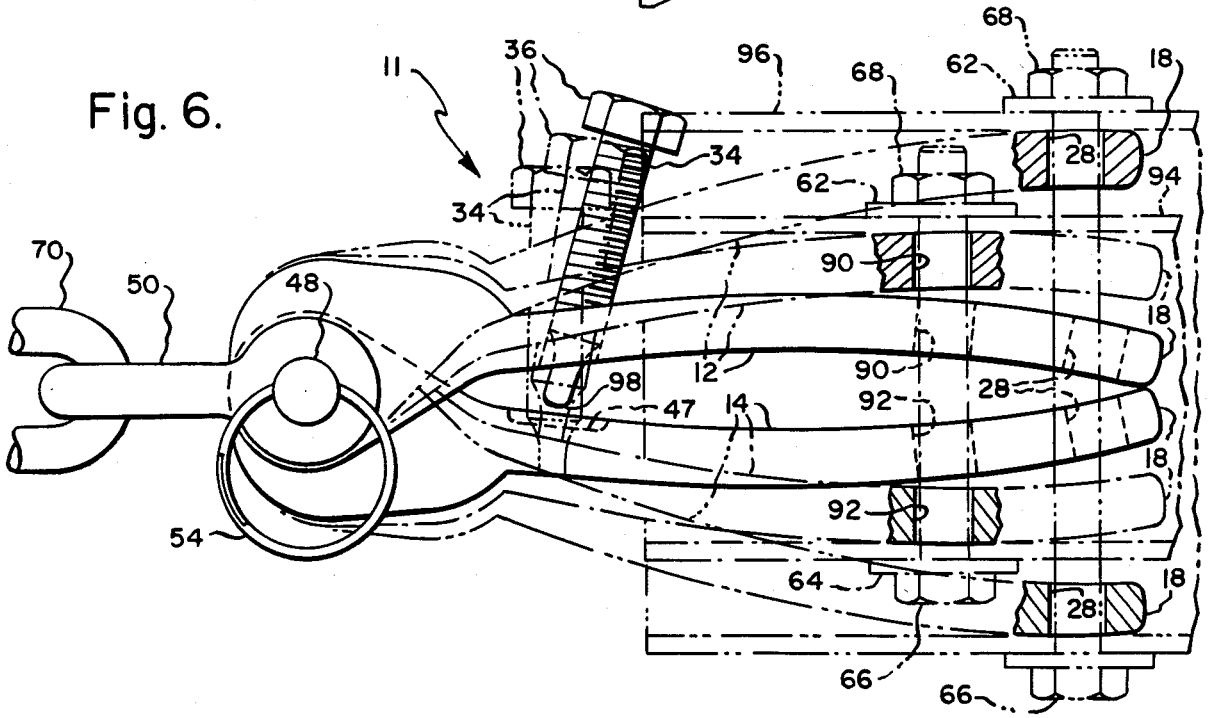
FIG. 6 is a side view of the clamp shown in FIGS. 4 and 5, this view illustrating in full lines the position of the clamp when initially inserted into a frame section, in first phantom lines the position of the clamp when engaging a box section of relatively small cross section, and in second phantom lines the position of the clamp when engaging a box section of larger cross section.

Two slightly differing forms of pulling clamps are illustrated in the various Figures., the first form being illustrated in FIGS. 1 through 3 and the second form being illustrated in FIGS. 4 through 6. The first form is designed for pulling frame members of relatively small cross sectional box constructions, or alternatively skirt rails and upper frame rails which do not have box shaped cross sections. The form illustrated in FIGS. 4 through 6 is designed primarily for pulling box cross section frame members which have intermediate to large cross sections.

First Embodiment

The first form of rail pulling clamp is illustrated in FIGS. 1 through 3 and is indicated generally at 10. It includes first and second elongated bow shaped members 12 and 14, respectively. Each bow shaped member has spaced apart inner and outer ends 16 and 18, respectively and convex and concave sides 20 and 22, respectively. In form illustrated in FIGS. 1 through 3 the bow shaped members are formed of mildly hardened bar stock material which is bent to the illustrated configuration. Pivot receiving means are secured adjacent the inner end of each of the bow shaped members 12 and 14, the pivot receiving means being in the form of thick washers 24, which are preferably welded to the ends 16.

In addition, bracing members 26 are suitably welded to the associated pivot receiving means 24 and the convex surface 20.

Each of the bow shaped members is further provided with an elongated bolt receiving slot 28 adjacent the outer end 18, which slot extends from one side 20 to the other side 22. The first bow shaped member 12 is further provided with first and second threaded apertures 30, 32, the first threaded aperture 30 being more closely disposed to the elongated slot 28 than the second threaded aperture 32. Mounted within the second threaded aperture is a threaded spreading member 34 having a head 36 provided with suitable flats which can be engaged by a wrench or the like. The other end of the threaded spreading member is provided with a foot 38 which is secured thereto by a conventional ball joint construction 40.

The second elongated bow shaped member 14 is also provided with a first threaded aperture 42, which when the parts are held together by a suitable pivot, will be in alignment with the first threaded aperture 30. The second member is also provided with first and second bearing surfaces 44, 46, the first bearing surface being disposed on the convex side between the first threaded aperture 42 and the pivot receiving means 24, and the second bearing surface 46 being disposed on the concave side 22 between the pivot receiving means 24 and the first bearing surface 44.

The first and second bow shaped members are held together by pivot means in the form of a clevis pin 48 which passes through the apertures in washers 24 and a clevis 50. The clevis pin is provided with a ball detent 52 at one end and a pull ring 54 at the other end, the ball detent and ring serving to maintain the clevis pin 48 in its assembled position. When the first and second elongated bow shaped members 12 and 14 are assembled together by means of the pivot means 48, not on y will the apertures 30, 42 be in alignment with each other but the elongated slots 28 will also be in alignment with each other.

The clamp described so far can be used as a pulling clamp. Thus, when it is desired to pull a rail of rectangular box section, the box section 56 will be provided with drilled holes 58, 60, which are in alignment with each other. Washers 62, 64 will now be suitably welded to the exterior surface of the frame section 56 with the holes in the washers 62 and 64 in alignment with the holes 58, 60. The threaded spreading member 34 is now turned in such a manner that the ends 18 of the bow shaped members of 12 and 14 can be brought closely together, and the pulling clamp will then be inserted into the frame rail 56 in such a manner that the slots are in alignment with the holes 58 and 60. A bolt 66 will now be passed through the holes 58 and 60 and slots 28 to secure the various part together, the bolt 66 being secured in place by nut 68. The threaded spreading member 34 will now be turned in the opposite direction to cause foot 38 to bear against bearing surface 46 to spread the ends 18 of the first and second members away from each other until they firmly engage the inside walls of the box frame member 56. A hook 70 or the like will now be passed through the clevis 50 and a suitable pulling force can be applied to the rail 56 to bring it back to its desired position.

By securing the pulling clamp 10 at two points the frame technician can use more power than if the pulling clamp were only secured at one point. In addition, good control is achieved by pulling at two points as a common force is applied to both sides of the box section, which will keep the sides of the box section from buckling during pulling.

In some situations it may be desirable to apply additional clamping force to the end of the frame member, particularly when applying a compound angle pulling force. To this end gripping means, which are indicated generally at 72, may be mounted on either one of the bow shaped members 12 or 14 or both as illustrated in FIG. 3. The gripping means, are mounted on the convex surface of the bow shaped members. Each of the gripping means includes an elongated bar-shaped gripping member 74, the gripping member 74 being provided with a separate bearing surface 76 at one end, and first and second threaded apertures 78, 80. The bearing surface is disposed on that side of the bar-shaped member which is adjacent the convex surface 20. The bearing surface can cooperate with a suitable corresponding separate surface 82 on the associated elongated bow shaped member 12 or 14, which surface 82 is disposed between the elongated slot 28 and the first threaded aperture 30. The gripping means further includes a bolt 84 which passes through the first aperture 78 in the gripping member 74, the bolt also passing through the first aperture 30 on the associated bow shaped member 12 or 14 to mount the gripping means 72 on the convex surface of the bow shaped member. The gripping means further includes a second bolt 86 which is screwed in to the second threaded aperture 80 in member 74, the bolt 86 being provided with a rounded end 88 which is adapted to bear against the bearing surface 44.

When the pulling clamp is utilized in the manner indicated in FIG. 3, after the spreading member 34 has spread the bow shaped members apart as indicated the gripping means are mounted on to the bow shaped members. Bolt 84 will initially tighten down to bring the bearing surface 76 into contact with a portion of the rail, and then bolt 86 will be tightened further to ensure proper firm engagement.

While not illustrated, it should be appreciated that if a piece of sheet metal were to be pulled, or if a frame section, which is not of a box cross section, were to be pulled that one half of one of the clamps illustrated in FIGS. 1 through 3 could be utilized. Thus, the two bow shaped members 12 and 14 could be disassembled from each other, and the clevis pin 48 could then be reinserted only through one of the washers 24 to secure a clevis to one of the members 12 or 14. Again, a suitable hole will be drilled through the metal to be pulled, re-enforced by a suitable washer which is welded about the hole, and bolted in place with a bolt. The clamp 72 will also be utilized to further secure a single bow shaped member to the material to be pulled to provide a secure two point holding system.

It can be seen from an inspection from FIGS. 1 through 3 that the bow shaped sections 12 and 14 have a substantial straight section which extends from the ends 18 all the way back to the bearing surface 44 and even a little bit beyond that point.

Second Embodiment

The second form of rail pulling clamp is illustrated in FIGS. 4 through 6 and is indicated generally at 11. It is in many respect very similar to that shown in FIGS. 1 through 3, with the principal exception that the second embodiment, is designed for pulling box frames of a greater variety of widths, and it is not provided with means to which the second gripping means 72 may be secured. Thus, in this design, the first threaded aperture 30 or 42 is replaced with an elongated bolt receiving slot 90, 92. When pulling a box cross section frame member 94 of intermediate width, after suitable holes have been drilled in the frame member and washers 62 and 64 secured thereto, the pulling clamp of this design is inserted into the frame member and a bolt 66 will be passed through the elongated slots 90 and 92, the bolt being secured in place by nut 68. The parts are then spread by engaging the head 36 of the threaded spreading member 34 and causing it to bear against suitable bearing surface on the other of the elongated bow shaped members. Once the parts have been suitably spread, it is then only necessary to engage the clevis 50 with a suitable pulling hook 70 in order to properly pull the parts.

When engaging a rail which has a large width box section the bolt 66 is in turn passed through the slots 28 which are closest to the ends 18 of the spreading members.

As shown in FIGS. 4 through 6, the pivot receiving means need not be separate washers which are welded on to the ends of the bow shaped members but can be merely apertures formed in the ends, the ends having been bent and reshaped to the desired position. Thus, the bow shaped members 12 and 14 of the pulling clamp 11 could be individual forged pieces. In addition, the threaded spreading member can be merely provided with rounded end portion 98 which can bear against a suitable bearing surface 47.

While two different forms of the present invention have been disclosed, it should be noted that other forms of apparatus may be employed for differing situations. Therefore, while preferred embodiments of the present invention have been shown and described above, it is to be understood that this invention is not to be limited to the particular details shown and described above, but that, in fact, widely differing means may be employed in the broader aspects of this invention.

What is claimed is:

1. A pulling clamp comprising:

a first elongated bow shaped member having spaced apart inner and outer ends and convex and concave sides, said member further being provided with an elongated bolt receiving slot adjacent the outer end and extending from one side to the other side, pivot receiving means adjacent the inner end, and first and second spaced apart apertures disposed between the elongated bolt receiving slot and the pivot receiving means and extending from one side to the other side, the first aperture being closer to the elongated bolt receiving slot than the second aperture, and the second being threaded;

a second elongated bow shaped member having spaced apart inner and outer ends and convex and concave sides, said second member further being provided with an elongated bolt receiving slot adjacent the outer end and exending from one side to the other side, pivot receiving means adjacent the inner end, a bearing surface on the concave side between the elongated slot and the pivot receiving means, a first aperture between the elongate slot and the bearing surface and extending from one side to the other side;

pivot pin means passing through said pivot receiving means and holding the first and second bow shaped members together with the concave sides facing each other; and threaded spreading means threaded into the second aperture on the first elongated bow shaped member and capable of bearing against the bearing surface on the second elongated bow shaped member to maintain the bow shaped members in a spread condition; and attaching means carried by the first and second elongated bow shaped members, said attaching means being capable of securing said members to a workpiece whereby said workpiece may be pulled.

2. The pulling clamp as set forth in claim 1 wherein the first aperture in each of the first and second bow shaped members is threaded, and wherein the attaching means are first and second gripping means associated with the convex surface of the first and second bow shaped members, respectively, each of the gripping means including an elongated bar-shaped gripping member provided with a bearing surface and first and second threaded apertures, the bearing surface being disposed adjacent one end of the elongated bar-shaped gripping member and adjacent the convex surface of the associated elongated bow shaped gripping member, the first thraeded aperture being disposed in an intermediate location and the second threaded aperture being disposed adjacent the other end of the gripping member, a bolt passing through the first threaded aperture in the elongated bar-shaped gripping member and the first threaded aperture in the associated elongated bow shaped member to mount the elongated bar-shaped gripping member on the convex surface, and a second bolt passing through the second thread aperture in the elongated bar-shaped member and capable of bearing against a surface on the associated elongated bow shaped member.

3. A pulling clamp comprising:

a first elongated bow shaped member having spaced apart inner and outer ends and convex and concave sides, said first bow shaped member further being provided with an elongated bolt receiving slot adjacent the outer end and extending from one side to the other side, pivot receiving means adjacent the inner end, first and second spaced apart threaded apertures disposed between the elongated bolt receiving slot and the pivot receiving means and extending from one side of the other side, the first aperture being closer to the elongated bolt receiving slot than the second aperture, and a bearing surface disposed on the convex side between the pair of threaded apertures;

a second elongated bow shaped member having inner and outer ends and convex and concave sides, said second member further being provided with an elongated bolt receiving means adjacent the outer end and extending from one side to the other side, pivot receiving means adjacent the inner end, a first threaded aperture between the elongated slot and the pivot receiving means and extending from one side to the other side, and first and second bearing surfaces, the first bearing surface being disposed on the convex side between the first threaded aperture and the pivot receiving means and the second bearing surface being disposed on the concave side between the pivot receiving means and the first bearing surface;

pivot means passing through both of said pivot receiving means and holding the first and second elongated bow shaped members together with the concave sides facing each other and with the elongated bolt receiving slots in alignment with each other;

a threaded spreading member threaded into the second threaded aperture on the first elongated bow shaped member and capable of bearing against the second bearing surface on the second elongated bow shaped member to maintain the parts in a spread condition; and first and second gripping means associated with the convex surface of the first and second bow shaped members, respectively, each of the gripping means including an elongated bar-shaped gripping member provided with a bearing surface and first and second threaded apertures, the bearing surface being disposed adjacent one end of the elongated bar-shaped gripping member and facing the convex surface of an associated elongated bow shaped gripping member, the first threaded aperture being disposed in an intermediate location and the second threaded aperture being disposed adjacent the other end of the gripping member, a bolt passing through the first threaded aperture in the elongated bar-shaped gripping member and the first threaded aperture in the associated elongated bow shaped member to mount the gripping member on the convex surface, and a second bolt passing through the second threaded aperture in the elongated bar-shaped member and capable of bearing against the first bearing surface on the associated elongated bow shaped member.

4. A pulling clamp comprising:

an elongated bow shaped member having spaced apart inner and outer ends and convex and concave sides, said bow shaped member further being provided with an elongated bolt receiving slot adjacent the outer end extending from one side to the other side, pivot receiving means adjacent the inner end, and a first threaded aperture disposed between the elongated bolt receiving slot and the pivot receiving means and extending from one side to the other side; and gripping means associated with a surface of the bow shaped member, the gripping means including an elongated barshaped gripping member provided with a bearing surface and first and second threaded apertures, the bearing surface being disposed adjacent one end of the elongated bar-shaped gripping member and adjacent said surface of the associated elongated bow shaped member, the first threaded aperture being disposed in an intermediate location, and the second threaded aperture being disposed adjacent the other end of the gripping member, a bolt passing through the first threaded aperture in the elongated bar-shaped gripping member and the first threaded aperture in the associated elongated bow shaped member to mount the elongated bar-shaped gripping member on the convex surface, and a second bolt passing through the second threaded aperture in the elongated bar-shaped member and capable of bearing against a surface on the associated elongated bow shaped member, and a bolt adapted to be positioned in the bolt receiving slot.

5. A pulling clamp comprising:

a first elongated bow shaped member having spaced apart inner and outer ends and convex and concave sides, said member further being provided with first and second spaced apart elongated bolt receiving slots which extend from one side to the other side of the bow shaped member, one slot being disposed more closely adjacent the outer end than the other slot, pivot receiving means adjacent the inner end, and a threaded aperture extending from one side to the other side of the bow shaped member and being between the second elongated bolt receiving slot and the pivot receiving means;

a second elongated bow shaped member having inner and outer ends and convex and concave sides, the second elongated bow shaped member further being provided with first and second elongated bolt receiving slots extending from one side to the other side of the bow shaped member, the first elongated bolt receiving slot being disposed closer to the outer end of the second bow shaped member than the second elongated bolt receiving slot, pivot receiving means adjacent the inner end, and a bearing surface on the concave side between the second elongated slot and the pivot receiving means;

pivot pin means passing through said pivot receiving means and holding the first and second bow shaped member together with the concave side facing each other;

threaded spreading means threaded into said threaded aperture and capable of bearing against the bearing surface to maintain the parts in a spread condition; and attaching means carried by the first and second elongated bow shaped members, said attaching means being capable of securing said members to a workpiece whereby said workpiece may be pulled.

* * * * *